United States Patent [19]

Moreira

[11] Patent Number: 4,573,229

[45] Date of Patent: Mar. 4, 1986

[54] SIDE AND HEEL LASTING MACHINE

[75] Inventor: Anthony F. Moreira, Nashua, N.H.

[73] Assignee: International Shoe Machine Corporation, Nashua, N.H.

[21] Appl. No.: 635,987

[22] Filed: Jul. 30, 1984

[51] Int. Cl.[4] ..... A43D 21/12; A43D 21/00

[52] U.S. Cl. ..... 12/8.1; 12/10.5; 12/145

[58] Field of Search ..... 12/8.1, 8.2, 8.3, 12, 12/12.5, 10, 10.5, 10.8, 14.3, 145

[56] References Cited

U.S. PATENT DOCUMENTS

| | | | |
|---|---|---|---|
| Re. 29,120 | 1/1977 | Vornberger | 12/10.5 |
| 3,292,190 | 12/1966 | Kneeland | 12/8.1 |
| 3,775,797 | 12/1973 | Kamborian et al. | 12/8.1 |
| 4,082,060 | 4/1978 | Vornberger et al. | 12/10.5 |
| 4,095,302 | 6/1978 | Boddy | 12/8.1 |

*Primary Examiner*—Werner H. Schroeder
*Assistant Examiner*—Steven N. Meyers
*Attorney, Agent, or Firm*—Robert Shaw

[57] ABSTRACT

A machine for lasting sides and heels of a shoe assembly having a last with an upper mounted thereon and an insole at its bottom, the assembly being one whose toe portion has already been wiped and whose side and heel portions are to be wiped. Nozzles serve to apply adhesive as a ribbon into the region between the insole and the unwiped margin at and near the insole periphery. A lasting mechanism provides backup to the margin to permit the nozzles to press outwardly against and track the margin. Later the lasting mechanism applies inward and downward pressure onto the margin. The lasting mechanism includes a lasting instrumentality at each side of the shoe assembly. Each such instrumentality includes an inner, an intermediate and an outer flexible lasting pad; each pad has relatively rigid segmets at its top edge; and each is moved by air cyliers to perform its function. The inner lasting pad performs a backup function during application of adhesive and a wiping function. Its relatively rigid segments are attached to the respective air cylinders by a clevis and pin arrangement which permits the relatively rigid segments to rotate through about ninety degrees between the backup function and the wiping function.

3 Claims, 7 Drawing Figures

SIDE AND HEEL LASTING MACHINE

The present invention relates to side and heel lasting machines for shoes and other footwear.

Attention is called to U.S. Pat. No. Re. 30,646 (Vornberger et al).

Hereinafter emphasis is placed on the present invention in the context of a machine for lasting shoes. The Vornberger et al patent discloses in great detail a machine for side and heel lasting; the present invention should be viewed in the context of that patent. Briefly, a shoe assembly, formed of a last having an insole at its bottom and an upper mounted thereon, whose toe-portion margins have been previously wiped against and secured to the insole, is presented to the machine. A liquid adhesive is applied as a ribbon for the unwiped side and heel portions which are thereafter wiped. Wiping is achieved by a lasting tool that provides a light back-up pressure during the application of the adhesive and thereafter presses the upper margin upon the insole to adhere the margin to the insole. It has been found that the linkage employed to apply wiping forces upon the insole have sometimes not applied adequate forces to effect adherence between the margin and the insole.

Accordingly, it is a principal objective of the present invention to provide a linkage whose forces are better adapted to apply forces between the margin and the insole, thereby to enhance adherence therebetween.

This and still further objectives are addressed hereinafter.

The foregoing objectives are attained, generally, in a footwear forming machine operable on a footwear upper assembly having a last with an upper mounted thereon and an insole; the toe portion of the assembly has been wiped and secured to the insole. The assembly is mounted in the machine, insole upwardly oriented with unwiped margin portions extending upwardly at an open angle to the insole. The machine includes means for applying an adhesive in the region between the unwiped margin portions and the corresponding portion of the insole (near or in the vicinity of the periphery thereof) at said region and a lasting mechanism operable to clamp the upper against the margin to support the same, but nevertheless maintain the open angle between the unwiped margin portion and the insole to permit application of adhesive into said region. The lasting mechanism includes a lasting pad at each side of the footwear, each lasting pad being made of an elastic, flexible and deformable material, the top end of each lasting pad being formed into a plurality of relatively rigid segments. The lasting mechanism further includes actuator means to press the lasting pad at each side of the footwear assembly against the side of the footwear assembly in order to press the upper against the last towards the insole edge line and to apply said backup pressure while maintaining said open angle. The actuator means includes a plurality of actuator elements, each element being associated with a corresponding relatively rigid segment and operable to apply linear, inwardly-directed forces upon the associated rigid segment to apply the backup pressure during the application of adhesive into said region and to apply high wiping forces on the associated rigid segment subsequent to the application of the adhesive. The high wiping forces serve to tighten and fold the margin onto the insole to press the adhesive between the margin and the insole to adhere the margin onto the insole. Each actuator element comprises a rod which engages the associated rigid segment, there being clevis and pin attachment between a rod and its corresponding rigid segment. The clevis and pin attachment permits the rigid segment to cause the top edge of each pad to pivot through about ninety degrees during the wiping action greatly increasing the downward force upon the margin.

The invention is hereinafter described with reference to the accompanying drawing in which.

Figure 1:
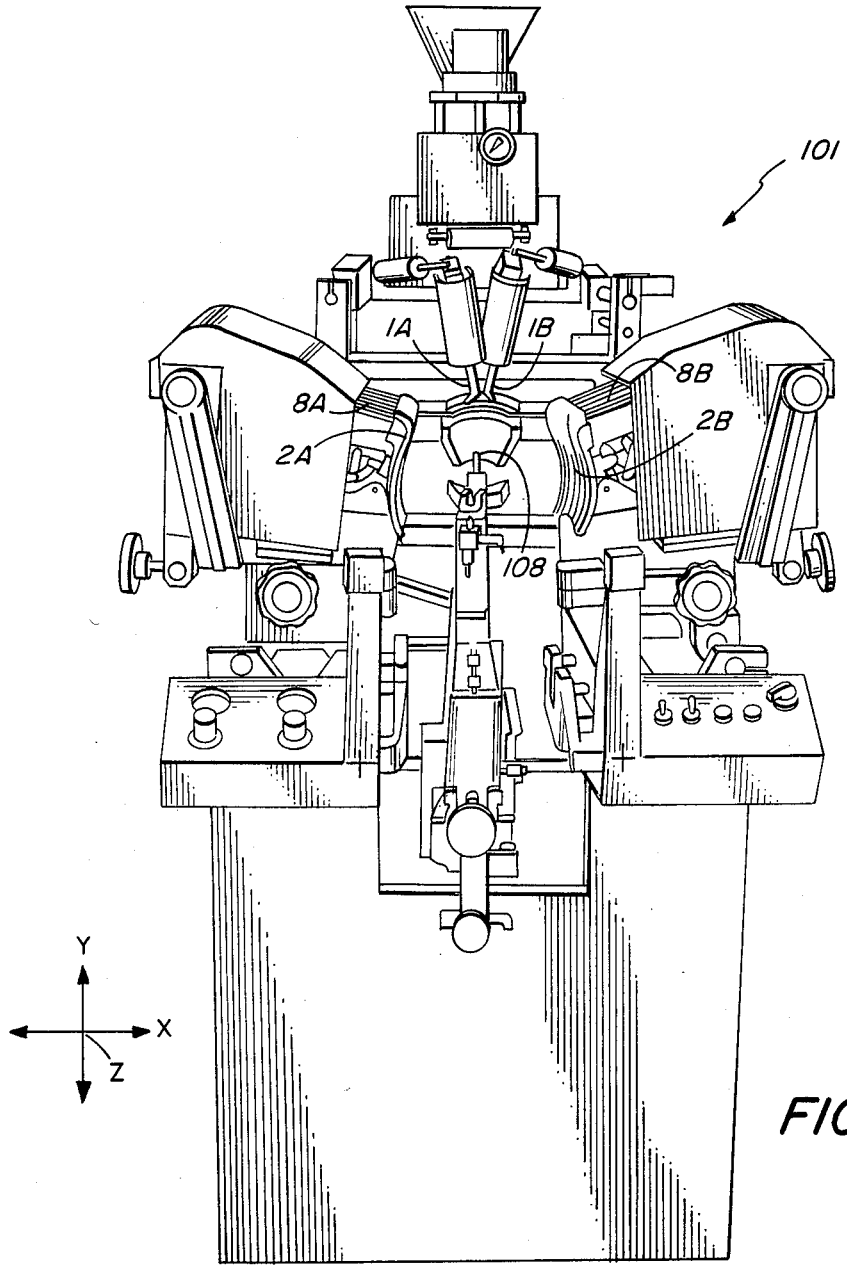
FIG. 1 is a front view looking slightly downward onto a machine having a lasting mechanism that embodies the present inventive concepts.
Figure 5:
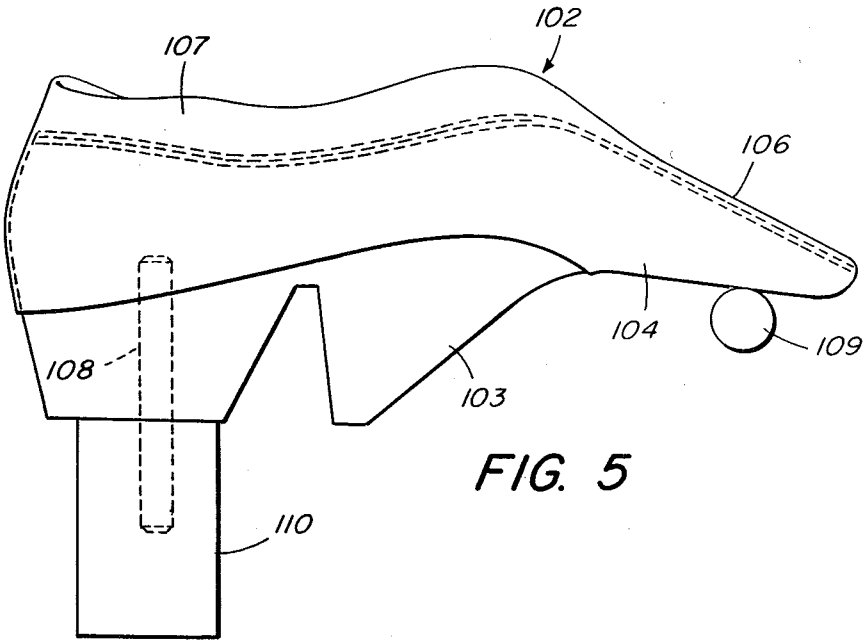
FIG. 5 shows a footwear assembly to be side and heel lasted by the machine of FIG. 1.
Figure 7:
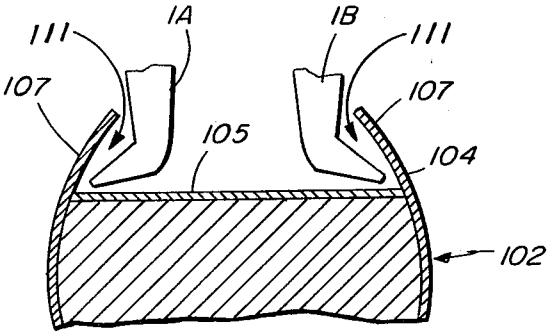
FIG. 7 is a section view similar to FIG. 6 except without the lasting mechanism, to show two nozzles in place to apply an adhesive in the region of the open angle between the margin and the insole of the footwear upper.
Figure 6:
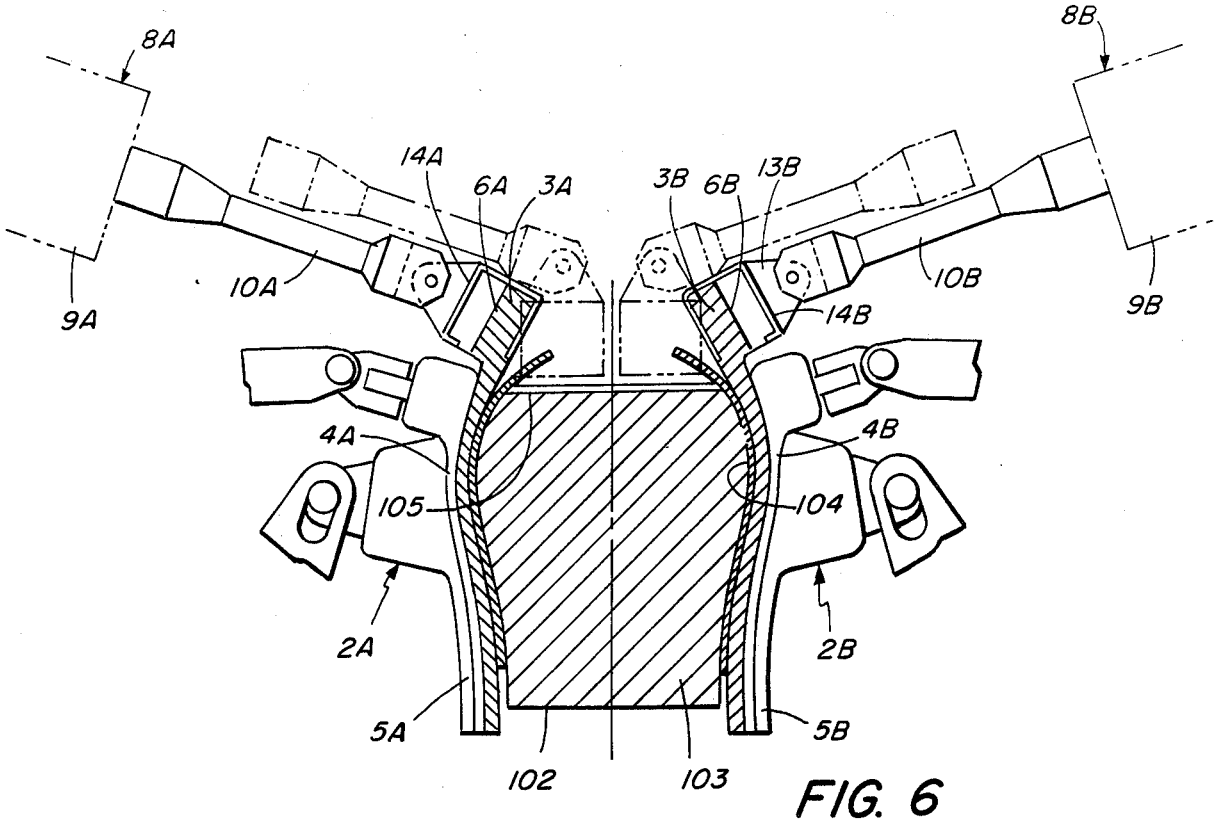
FIG. 6 shows the footwear assembly of FIG. 5 in section view to illustrate the steps performed during side and heel lasting.

Turning now to FIG. 1, there is shown at 101 a shoe forming machine operable on a shoe assembly 102 in FIGS. 5, 6 and 7. The assembly 102 consists of a last 103 with an upper 104 mounted thereon and an insole 105 upwardly oriented thereon. The toe portion labeled 106 (FIG. 5) of the upper margin is wiped against and secured to the insole; unwiped margin portions 107 of the upper extends heelwardly of the wiped margin portion 106. The unwiped margin portions 107 extend upwardly at an open angle to the insole 105 in FIG. 7; nozzles 1A and 1B (FIGS. 1 and 7) apply a liquid adhesive ribbon in the region labeled 111 between the unwiped margin portions and the corresponding portions of the insole at the region, as discussed in great detail in the Vornberger et al patent and later herein. The operator is intended to stand in front of the machine 101 in FIG. 1. Directions extending toward the operator (plus Z-direction) will be designated as "forward", directions extending away from the operator (minus Z-direction) will be designated "rearward", and directions to the left or right (i.e., plus and minus X-direction in FIG. 1) will be designated lateral or transverse. The front of the machine 101 is closest to the operator and the back of the machine is furthermost from the operator. The plus Y-direction is upwardly in the context of this explanation but "upwardly" does not necessarily designate vertical orientation. The coordinate system is given merely to facilitate this explanation.

As is discussed in great detail in the Vornberger et al patent, to achieve lasting of the side and heel of the shoe assembly 102 it is placed in the machine 101 with its insole facing upward and its toe portion 106 facing forward. A pin 108 in FIG. 5 is rocked clockwise by a spindle 110 pressing the toe of the assembly 102 firmly upon a toe rest 109. The nozzles 1A and 1B are lowered onto the insole 105; these have air-spring lateral (outward) forces upon them to urge them to engage the upwardly extending margin 107 (FIG. 7) at about the ball of the shoe assembly 102. Thereafter the nozzles move rearwardly of the assembly, tracking the upstanding margin from the ball region to the heel and depositing a liquid ribbon of adhesive into the region 111 of the open angle between the margin and the insole. The adhesive may be applied as a ribbon onto the insole or onto the margin: the nozzles 1A and 1B in FIG. 7 are shown spaced from both but in fact they press against and track both the insole and the upstanding margin. One function of the lasting mechanism described below is to provide light backup pressure to the margin sufficient to overcome the outward air-spring forces of the nozzles, but not so strong that the margins 107 are pushed inwardly thereby closing the open angle at the region 111 during adhesive application.

The lasting mechanism to perform the foregoing includes the lasting instrumentalities generally labeled 2A and 2B in FIG. 1. In the present description, in general, elements at the left side of the machine 101 are designated by a numeral plus the letter "A": those to the left by a numeral plus the letter "B", it being noted that the right side of the machine 101 is a mirror image of the left side.

The lasting mechanism includes a lasting pad 3A and 3B at each side of the assembly 102 in FIG. 6, each lasting pad 3A and 3B being made of an elastic flexible and material (e.g., urethane). (In fact the lasting mechanism in the disclosed embodiment includes three lasting pads, 3A, 4A and 5A and 3B, 4B and 5B respectively disposed at either side of the assembly 102, as discussed below.) The top of the pads 3A and 3B are formed into a plurality of relatively rigid segments 6A and 6B. The lasting mechanism further includes actuator mechanisms shown generally at 8A and 8B to press the lasting pad(s) at each side of the shoe assembly 102 against the side of the assembly in order to press the upper against the last towards the insole edge line or periphery to prevent adhesive from dripping into the assembly and to apply the light backup pressure discussed above, while maintaining the angle between the margin and the insole of sufficiency for the nozzles 1A and 1B to enter.

Figure 4:
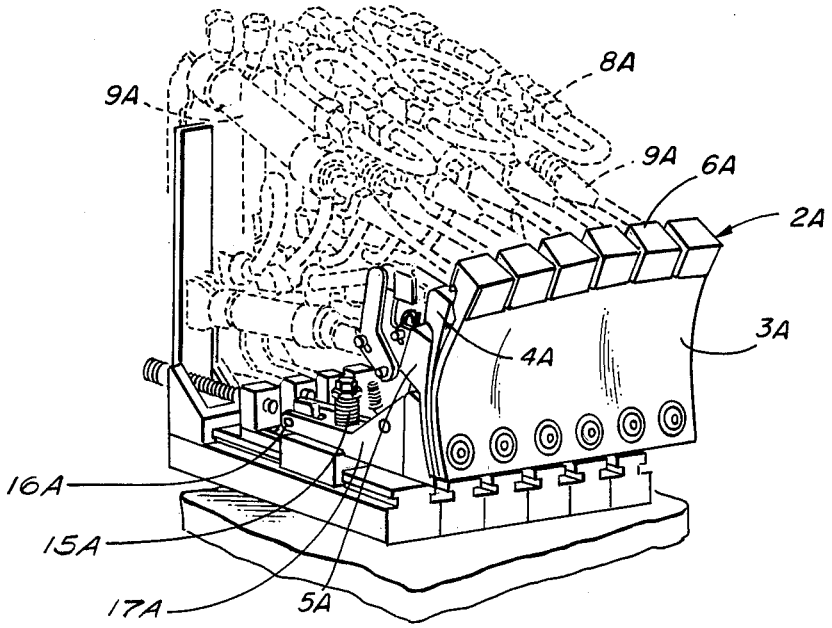
FIG. 4 is an isometric view of the lasting pad of FIG. 2 and further lasting pads together with closely associated machine elements.

The actuator mechanisms 8A and 8B in FIGS. 1 and 6 each include a plurality of actuator elements 9A and 9B, each being associated with a corresponding rigid segment 6A and 6B, respectively. Similar actuator elements apply inward forces upon the relatively rigid segments of the pads 4A, 5A, 4B and 5B. The actuator elements 9A and 9B are double acting air cylinders that apply linear forces inwardly upon the associated rigid segment of the pads 3A and 3B to apply the before-mentioned light backup pressure during application of adhesive into the region within the open angle and to apply high wiping forces on the associated rigid segment, subsequent to the application of the adhesive, to fold the margin 107 downwardly onto the insole to press the adhesive between the margin and the insole to adhere the margin onto the insole. It will be noted that the rigid segments 6A and 6B pivot from a position that is nearly vertical in FIG. 6 to one that is horizontal so that the final pressing forces by the rigid segments 6A and 6B upon the margin 107 is nearly vertically downward. It should also be noted that as the relatively rigid segments 6A and 6B move inwardly in FIG. 6 from the solid-line position to the broken-line position, inward pressure by the rigid segments of the pads 4A, 4B, 5A and 5B upon the upper 104 is withdrawn; hence, as the segments 6A and 6B of the pads 3A and 3B, respectively, move inwardly, the upper 104 is stretched about the last 103. The upward forces thus applied on the pad 3A (and also 3B) causes the pad to apply pivoting forces on a platform 17A in FIG. 4 about a pivot 16A against pressure of springs 15A . . . (similar springs are found at the right side of the machine 101). Hence the rigid segments 6A (and 6B) moves inwardly, but they also move upwardly at the same time stretching the upper 104 about the last 103.

To permit the almost ninety degree pivoting to occur between the actuators and the associated rigid members, each of the actuators is provided with a rod 10A (and 10B) which engages the associated rigid element, there being a clevis 11A (see FIGS. 2 and 3) and pin 12A attachment between a rod 10A and its corresponding rigid segment 6A.

As above indicated and as is shown in the drawing, the lasting mechanism includes three pads at each side of the shoe assembly. The lasting pads 3A and 3B are inner lasting pads, the pads 4A and 4B are intermediate lasting pads and the pads 5A and 5B are outer lasting pads. The pads 4A, 4B, 5A and 5B, provide some backup function, but they serve mostly to press the shoe upper against the last during application of adhesive and are released during the wiping function. The inner lasting pads 3A and 3B serve the backup function mentioned previously and the wiping function; and it is to the latter that the present invention is mostly directed.

Figure 2:
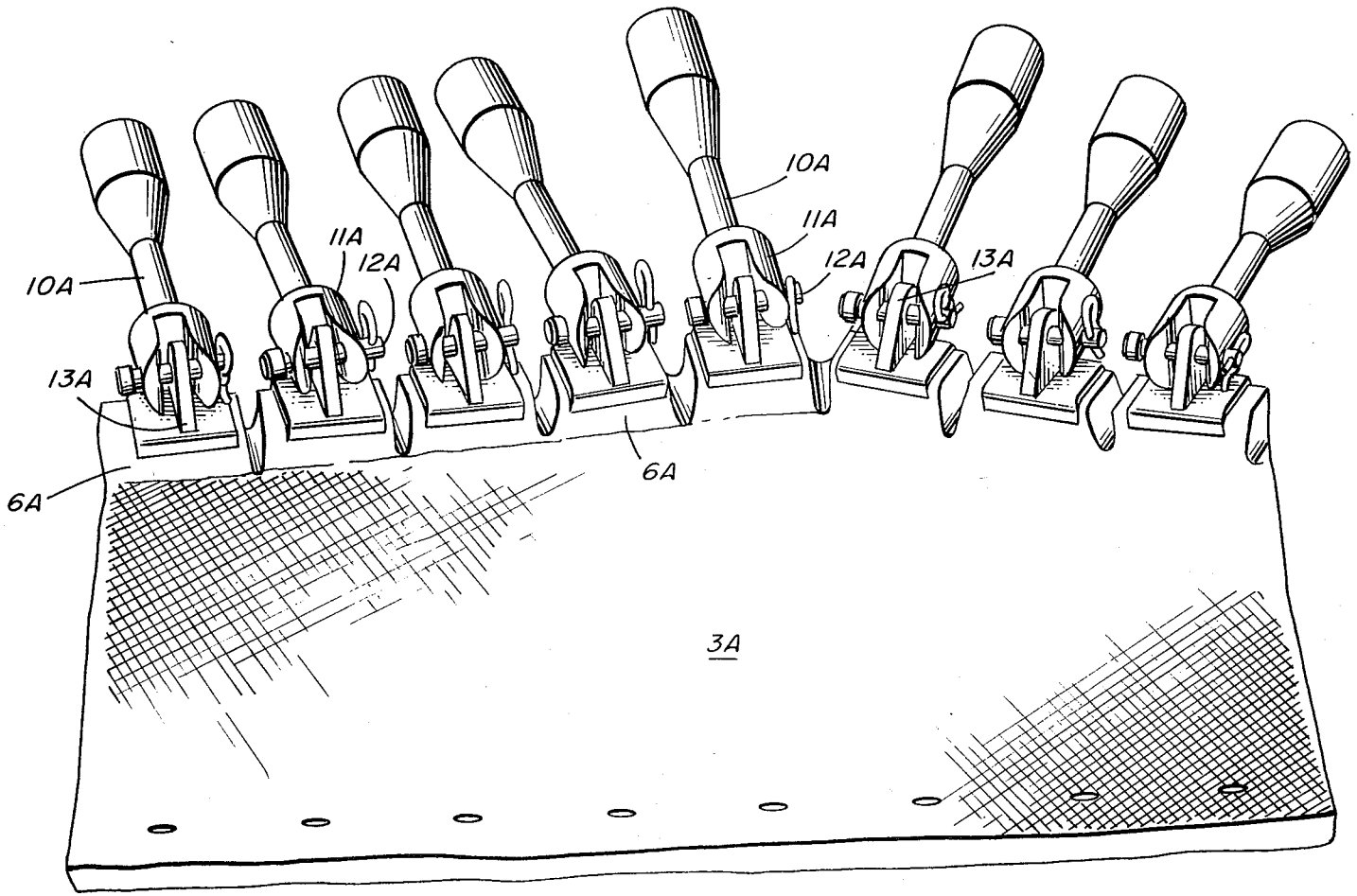
FIG. 2 is an enlarged isometric view of one lasting pad and actuator rods of the lasting mechanism in FIG. 1.
Figure 3:
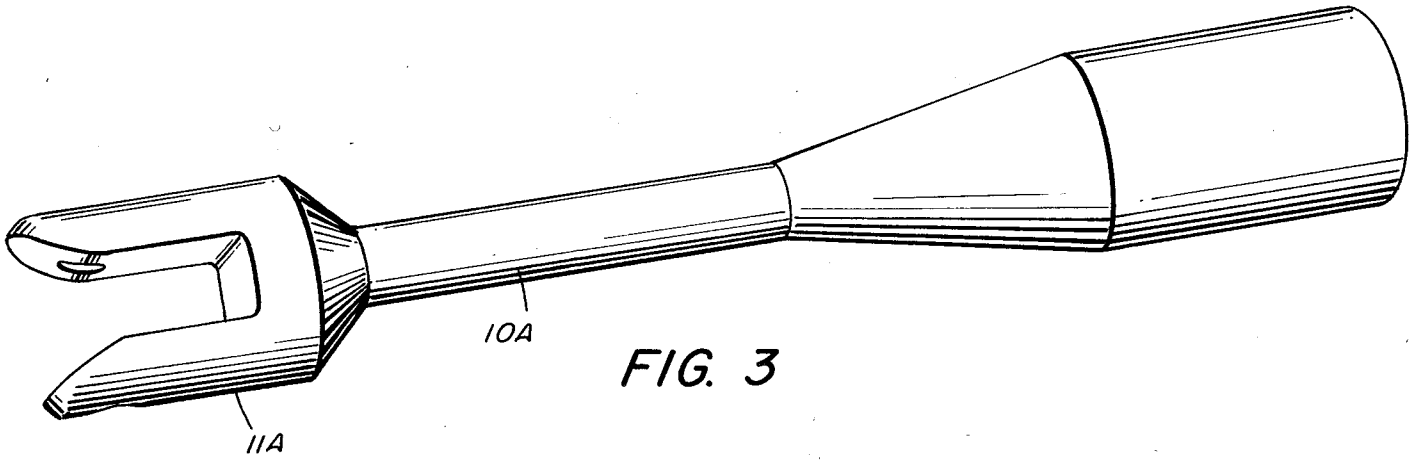
FIG. 3 is an enlarged isometric view showing a rod with a clevis at one end to engage the lasting pad.

The clevis and pin attachment best shown in FIGS. 2 and 6 permit the rigid segments to revolve through the almost ninety degrees needed to achieve wiping and to permit a conbination of inward linear forces and downward linear forces upon the margin being wiped. By providing rods such as 10A, each with a clevis at its free end, conversion of force directions is achieved. Each leg of the clevis has an aperture and the associated rigid segment has an apertured shoulder 13A (or 13B) that is received between the legs of the clevis, the apertures being registered to receive a pin, e.g., 12A, to retain the shoulder, e.g., 13A therein during lasting and to permit inwardly directed forces to be transmitted to the lasting pad. Each shoulder 13A and 13B is welded to a C-shaped, metal device 14A and 14B, respectively (FIG. 6) which is molded into the upper edge of the respective pad to form the relatively rigid segments referred to above. The relatively long shoulder 13A (or 13B) adds greater rotary moments to the associated rigid segment 6A (or 6B) during wiping, and hence greater downward forces upon the margin being wiped and greater forces against the springs 15A . . . .

Further modifications of the invention herein disclosed will occur to person skilled in the art and all such modifications are deemed to be within the scope of the invention as defined by the appended claims.

What is claimed is:

1. For use in a footwear forming machine, operable on a footwear assembly having a last with an upper mounted thereon and an insole upwardly oriented thereon with the toe portion of the upper margin wiped against and secured to the insole and unwiped margin portions of the upper extending heelwardly of the wiped margin portions, which unwiped margin portions extend upwardly at an open angle to the insole, said machine including means for applying adhesive in the region between said upwiped margin portions and the corresponding portions of the insole at said region, a lasting mechanism operable to clamp the upper tightly against the last and to apply backup pressure for the unwiped margin to support the same, but nevertheless maintaining the open angle between the unwiped margin portions and the insole to permit application of adhesive into said region, said lasting mechanism comprising a lasting pad at each side of the footwear assembly, each lasting pad being made of an elastic, flexible and deformable material, the top end of each lasting pad being formed into a plurality of relatively rigid segments, said lasting mechanism further including actuator means to press the lasting pad at each side of the footwear assembly against the side of the footwear assembly in order to press the upper against the last towards the insole edge line and to apply said backup pressure while maintaining said open angle, said actuator means including a plurality of actuator elements, each being associated with a corresponding relatively rigid segment, to apply linear inward-directed forces upon the associated relatively rigid segment to apply said backup pressure during the application of adhesive into the region and to apply high wiping forces on the associated relatively rigid segment, subsequent to the application of the adhesive, to fold the margin onto the insole to press the adhesive between the margin and the insole to adhere the margin onto the insole, wherein each actuator element comprises a rod having a clevis at its free end with an aperture in each leg of the clevis and said associated relatively rigid segment having an apertured shoulder rigidly secured as an integral part thereof, said shoulder being received between the legs of the clevis, the aperture of the shoulder being registered with the aperture of each leg of the clevis to receive a pin to pivotally retain the shoulder therein during lasting and to permit inwardly directed forces to be transmitted to the lasting pad, said shoulder, in the course of wiping, pivoting about the pin to provide downwardly-directed forces on the margin being wiped.

2. Apparatus according to claim 1 in which the adhesive is applied at or near the periphery of the insole in said region.

3. Apparatus according to claim 1 in which the clevis and shoulder, in combination, serve to convert linear forces on the rod to rotary moments on the shoulder to pivot the shoulder about the pin and hence revolve the associated relatively rigid segment through the almost ninety degrees needed to effect wiping while simultaneously stretching the upper about the last, said shoulder being relatively long to add greater rotary moments to the associated rigid segment during wiping.

* * * * *